US012013189B2

(12) United States Patent
Galland et al.

(10) Patent No.: US 12,013,189 B2
(45) Date of Patent: Jun. 18, 2024

(54) HEAT EXCHANGER PLATE, AND HEAT EXCHANGER COMPRISING SUCH A PLATE

(71) Applicant: Valeo Systemes Thermiques, Le Mesnil-Saint-Denis (FR)

(72) Inventors: Jean-Pierre Galland, Le Mesnil Saint Denis (FR); Nicolas Vallee, Le Mesnil Saint Denis (FR); Yoann Naudin, Reims (FR); Frederic Wascat, Reims (FR); Eddie Sausset, Reims (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 878 days.

(21) Appl. No.: 16/964,002

(22) PCT Filed: Jan. 23, 2018

(86) PCT No.: PCT/EP2018/051609

§ 371 (c)(1),
(2) Date: Nov. 11, 2020

(87) PCT Pub. No.: WO2019/145022

PCT Pub. Date: Aug. 1, 2019

(65) Prior Publication Data

US 2021/0071961 A1 Mar. 11, 2021

(51) Int. Cl.
*F28D 9/00* (2006.01)
*F28F 9/007* (2006.01)

(52) U.S. Cl.
CPC ..... *F28D 9/0031* (2013.01); *F28F 9/0075* (2013.01); *F28F 2265/26* (2013.01); *F28F 2275/04* (2013.01)

(58) Field of Classification Search
CPC ..... F28F 2265/26; F28F 9/001; F28F 9/0075; F28D 9/0031

(Continued)

(56) References Cited

U.S. PATENT DOCUMENTS 4,253,520 A 3/1981 Friedericy et al.
2004/0251002 A1* 12/2004 Reichle ..... F28F 9/001 165/149

(Continued)

FOREIGN PATENT DOCUMENTS

CN 1346962 A 5/2002
CN 104541121 A 4/2015

(Continued)

OTHER PUBLICATIONS

International Search Report and Written Opinion in corresponding International Application No. PCT/EP2018/051609, dated Jan. 23, 2018 (12 pages).

(Continued)

*Primary Examiner* — Tho V Duong
(74) *Attorney, Agent, or Firm* — Osha Bergman Watanabe & Burton LLP

(57) ABSTRACT

The invention relates to a plate for a heat exchanger, said plate comprising an edge (11) for coupling to another plate. According to the invention, said edge has at least one fusible component (20) for joining this coupling edge (11) to at least one casing wall, said at least one fusible component (20) being configured to be separated from the rest of said coupling edge by differential expansion/contraction between said plate and said at least one casing wall to which it is intended to be joined.

17 Claims, 4 Drawing Sheets

(58) Field of Classification Search
USPC ..... 165/81, 82, 149
See application file for complete search history.

(56) References Cited

U.S. PATENT DOCUMENTS

| | | | | |
|---|---|---|---|---|
| 2005/0150641 | A1* | 7/2005 | Calhoun | F28F 9/0202 165/149 |
| 2007/0261820 | A1 | 11/2007 | Rousseau et al. | |
| 2014/0246185 | A1* | 9/2014 | Onetti | F28F 3/08 165/166 |
| 2014/0345577 | A1* | 11/2014 | Meshenky | F28F 9/026 123/542 |
| 2016/0370127 | A1* | 12/2016 | Okubo | F28F 9/001 |
| 2018/0038652 | A1* | 2/2018 | Dziubinschi | F28F 9/001 |
| 2018/0292147 | A1* | 10/2018 | Heine | F02B 29/0462 |
| 2021/0041177 | A1* | 2/2021 | Holmes | F28D 1/0233 |

FOREIGN PATENT DOCUMENTS

| | | | |
|---|---|---|---|
| CN | 104641195 | A | 5/2015 |
| CN | 206626984 | U | 11/2017 |
| EP | 0748995 | A2 | 12/1996 |
| EP | 1195573 | A1 | 4/2002 |
| FR | 2992715 | A1 | 1/2014 |
| JP | H07229687 | A | 8/1995 |

OTHER PUBLICATIONS

The First Office Action issued in corresponding Chinese Patent Application No. 201880091372.6, dated Jun. 24, 2021 (16 pages).

* cited by examiner

HEAT EXCHANGER PLATE, AND HEAT EXCHANGER COMPRISING SUCH A PLATE

The present invention relates to a plate for a heat exchanger, in particular for a heat exchanger with plates that are brazed to the walls of the casing.

It also relates to a heat exchanger comprising at least one such plate.

In motor vehicles, as in many other industrial fields, heat exchangers are used to provide the engine with operating conditions that are optimal in terms of temperature.

A system for air conditioning the interior of a vehicle also requires heat exchangers.

It is thus known to equip a vehicle with a plurality of heat exchangers, which are each equipped with a set of plates forming a bundle for heat exchange between a first heat transfer fluid and a second heat transfer fluid, this heat exchange bundle being housed in a casing.

For several decades, aluminum has become established as constituent metal of heat exchangers and, as a result, has replaced other metals, such as copper, that are used on account of their good thermal properties.

This is because aluminum allows a not insignificant saving in terms of weight, and aluminum alloys additionally exhibit entirely satisfactory thermal conductivity while having good corrosion resistance.

On account of the complexity of heat exchangers and the small dimensions that are allowed, the constituent elements of a heat exchanger are joined together, on an industrial scale, by brazing, and not by spot welding.

As shown in FIG. 1, the plates 2, 3 of a prior art heat exchanger 1 are thus typically joined to the casing 5 of the exchanger 1 by brazing, i.e. joined by adding metal in the liquid state to the metal parts to be joined.

Since these plates 2, 3 are brazed over their entire surface in contact with the casing walls 5, the metal thus added forms a continuous line 4.

This results in a lack of flexibility of the assembly thus obtained.

However, it is known that heat exchangers 1 are subjected to service loadings that are both strong and of various kinds: thermomechanical stresses and chemical reactions with more or less aggressive environments.

In particular, the existence of thermal shocks is observed, which are caused by a sudden and significant variation in temperature, for example when valves equipped with sensors are opened, allowing the engine temperature to be measured, and allowing the cold engine cooling water to pass into the hotter engine air intake circuit.

These thermal shocks result in phenomena of expansion/contraction of the plates 2, 3 of the heat exchanger 1, which are referred to as thermal cycles.

However, the lack of flexibility of these plates 2, 3 thus brazed generates significant stresses, which may result in the appearance of breaking regions in the plates 2, 3.

It is then observed that these breaking regions may cause leaks of heat transfer fluid.

There is therefore a pressing need for a plate for a heat exchanger, the original design of which ensures greater flexibility of the plate.

The present invention therefore aims to overcome the drawbacks of the prior art and to meet the constraints set out above by proposing a plate for a heat exchanger that has a simple design and mode of operation, is reliable and economical, and which makes it possible to limit, or even to prevent, the appearance of breaking regions associated with thermal shocks in the plate.

Another object of the present invention is such a plate for a heat exchanger, ensuring bearing engagement on the opposite walls of the casing with a view to joining it to a complementary plate by brazing so as to form a duct for circulation of a heat transfer fluid.

The present invention also targets a heat exchanger comprising at least one such plate for a heat exchanger, so as to have enhanced reliability.

To this end, the invention relates to a plate for a heat exchanger, said plate comprising an edge for coupling to another plate.

According to the invention, said edge has at least one fusible component for joining this coupling edge to at least one casing wall, said at least one fusible component being configured to be separated from the rest of said coupling edge by differential expansion/contraction between said plate and said at least one casing wall to which it is intended to be joined.

The plate for a heat exchanger may have any shape, such as square, rectangular, etc.

The "edge" of the plate is understood to mean the peripheral part of this plate that delimits a region of this plate for circulation of a heat transfer fluid, this peripheral part having an upper face, an edge face and a lower face.

In various particular embodiments of this plate, each of which has its own particular advantages and which may be combined in numerous possible technical combinations:

- said fusible component or at least one of said fusible components is carried by a corner of said plate or by a portion of the coupling edge that is close to this corner, said portion having a width ($h_1$) that is strictly greater than the width ($h_2$) of this coupling edge in a median part of said plate.

Purely by way of illustration, for a width $h_2$ of around 3 mm, this part may extend over a distance of between 0 and 30 mm, if a minimum width $h_1$ of 5 mm is ensured in this part.

Preferably, each fusible component is carried by a corner of the plate or a portion of the coupling edge that is close to this edge, because it is at these locations of the plate that the breaking of the fusible component is best controlled and that the distance separating the fusible component from the region of the plate where it is sought to preserve sealing is the greatest.

Furthermore, it is noted that it is in the corners of the plate that the thermal stresses are greatest. Positioning a fusible component in a corner of the plate thus ensures breaking or "breakage" thereof as quickly as possible, i.e. from the first thermal cycles.

- two opposite corners of said plate each have a fusible component for joining said coupling edge to a single casing wall or opposite casing walls.

In the latter embodiment, bearing points for the plate are thus advantageously formed on the opposite walls of the casing with a view to joining this plate to a complementary plate so as to form a duct for circulation of a heat transfer fluid.

- since said coupling edge has a width ($h_2$) in a median part of said plate that is greater than or equal to a predetermined safety width ($h_s$) for which a break in the fusible component does not propagate beyond said coupling edge, said edge has a fusible component in said median part of said plate.

Purely by way of illustration, this predetermined safety width $h_s$ is equal to 5 mm.

It is thus possible to position a fusible component outside a corner or a region of the edge that is close to this corner, for example in a median part of the plate, on the condition that the width of the coupling edge is sufficient to prevent any propagation of a break in the fusible component beyond this edge.

each fusible component has a predetermined weakening region so as to bring about separation thereof from the coupling edge.

This configuration of the fusible component makes it possible to achieve another objective of the present invention, namely obtaining a "clean" break, or clear separation, of the fusible component from the coupling edge, so that this break does not tend to propagate beyond the coupling edge, i.e. in the area of the plate that is delimited by this edge and in which a heat transfer fluid is intended to circulate.

Since said coupling edge extends in a main plane (P), the predetermined weakening region is advantageously contained in this main plane (P) and preferably belongs to this edge.

Advantageously, said or at least one fusible component has a line of lower mechanical strength so as to break along this line.

This line of lower mechanical strength therefore has a breaking strength that is lower than that of the metallic material surrounding it.

Advantageously, this line of lower strength is intended to bring about the separation, preferably in a single piece, of the part of the fusible component that is connected to this line of lower strength.

Purely by way of illustration, it may be a question of orifices that are disposed linearly, or in a rectilinear manner, so as to form a "perforated material line".

Alternatively, or in addition, said or at least one fusible component has at least one notch.

By way of example, said fusible component has a first line of lower strength, two notches being situated on either side of this line of lower strength.

Again alternatively, this line of lower strength is obtained by local thinning.

each fusible component has a tab that is connected by said predetermined weakening region to the coupling edge, said tab being curved so as to have a joining surface, which is preferably flat or substantially flat, that is intended to be joined, by brazing, to a casing wall.

Since said coupling edge is contained in a main plane (P), this joining surface advantageously extends perpendicular to the main plane (P).

said plate comprises a fluid inlet and a fluid outlet, each of the fluid inlet and fluid outlet having a collar.

Purely by way of illustration, said fluid inlet and fluid outlet are placed in a median or substantially median part of the plate. Alternatively, said fluid inlet and fluid outlet are placed on the same side of the plate.

Such a plate has at least one fusible component on at least one of its sides. Preferably, fusible components are placed on two of the opposite sides of this plate.

Alternatively, a first side of this plate comprises a fluid inlet and a fluid outlet that are placed at the head of the plate.

In this configuration of the plate, this first side has a continuous lip and the opposite side of said plate from said first side has at least one fusible component, preferably two fusible components.

each fusible component has a surface for joining to a casing wall, the longitudinal dimension of which is between 3 and 20 mm.

said plate is in one piece and is made from a metallic material, such as aluminum or an aluminum alloy.

The casing walls are made from a metallic material, preferably aluminum or an aluminum alloy.

The present invention also relates to a pair of plates for a heat exchanger, as described above, the coupling edges of these plates being intended to be joined so as to delimit a duct for circulation of a heat transfer fluid between these plates, each coupling edge comprising at least one fusible component, said fusible components being arranged at the edges of said plates such that, after the latter have been joined, two fusible components belonging to separate plates are placed next to one another or are offset relative to one another.

In the latter case, the fusible components are advantageously placed in the continuation of one another.

Preferably, each fusible component is placed only in a corner of said plates.

The present invention also relates to a plate-type heat exchanger having at least two plates as described above, these two plates being joined together so as to delimit a duct for circulation of a heat transfer fluid between these plates, at least one edge of the assembly thus formed, which is connected to a casing wall, having, for each of these plates, at least one fusible component, said or at least some of said fusible components that are placed at this edge being positioned next to one another or being offset relative to one another.

In the latter case, the fusible components are advantageously placed in the continuation of one another. Advantageously, the offset of the fusible components that are placed at the same corner of the plates thus assembled allows an increase in the joining surface area of each fusible component intended to be joined to the casing wall by brazing.

In particular, it relates to a heat exchanger with brazed plates.

This heat exchanger may have a bundle for heat exchange between a first fluid and a second fluid, and a casing inside which this heat exchange bundle is placed.

Purely by way of illustration, the first fluid may be air and the second fluid may be a liquid coolant.

The second fluid may be, for example, a mixture of water and glycol. The air may for example be laden air.

Further advantages, aims and particular features of the present invention will become apparent from the following description, which is given for nonlimiting and explanatory purposes with reference to the appended drawings, in which.

Figure 9:
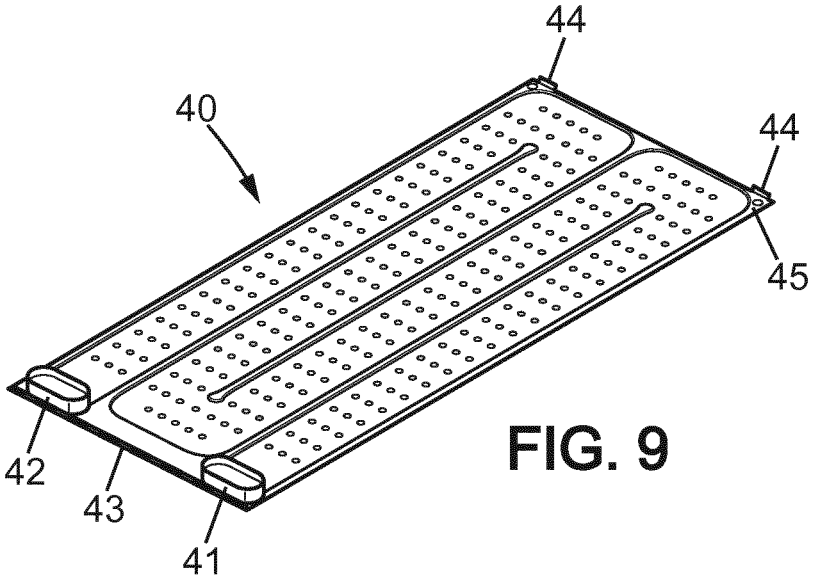

FIG. 9 schematically shows a plate for a heat exchanger, according to a third embodiment of the invention.

First of all, it is noted that the figures are not to scale.

FIGS. 2 to 5 schematically show a plate 10 for a heat exchanger, according to a first embodiment of the present invention.

This plate 10, which is in one piece, is made for example from aluminum or an aluminum alloy.

This plate 10 has a rectangular overall shape.

It has a coupling edge 11 and a concave area 12 delimited by this edge.

This plate 10 has on a first transverse edge 13, or side extending in a transverse direction, a fluid inlet 14 for introducing a fluid and a fluid outlet 15 for discharging the fluid, which are placed at the head of the plate.

This plate 10 also has a central rib 16 on the surface of its inner wall, which defines a projection for creating a separation on the surface of the inner wall of the plate 10 in order to define a U-shaped circuit between the fluid inlet 14 and fluid outlet 15.

In addition, this plate 10 has a plurality of protrusions 17 placed in the passage for circulation of the fluid on its inner wall, which are intended to disturb the circulation of the fluid.

This plate 10 has longitudinal edges 18 with dimensions slightly smaller than those of the upper and lower faces of the casing, and transverse edges 13 with dimensions equal or substantially equal to those of the lateral walls of the casing of the heat exchanger (not shown).

Figure 1:
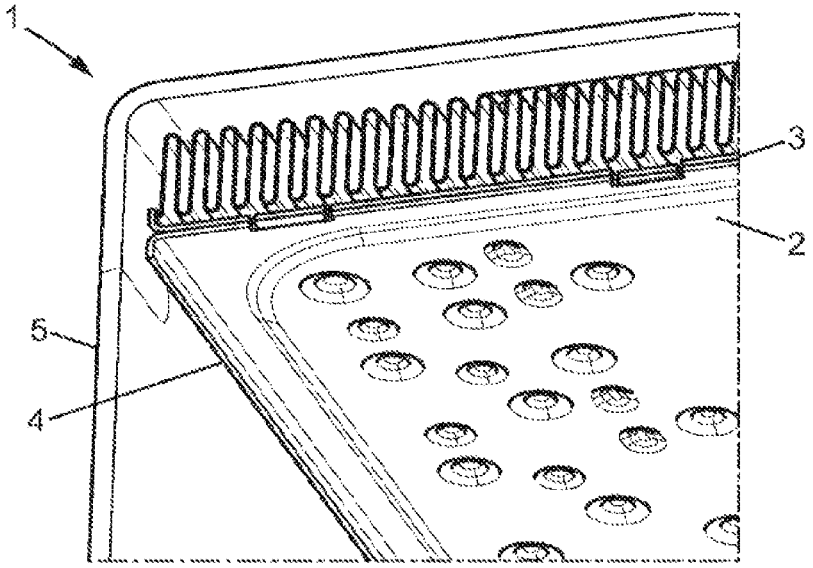
FIG. 1 (Prior Art)
FIG. 1 is a partial and enlarged view of a prior art heat exchanger, showing in particular a brazed joining line between a plate of the exchanger and the corresponding wall of the casing.
Figure 2:
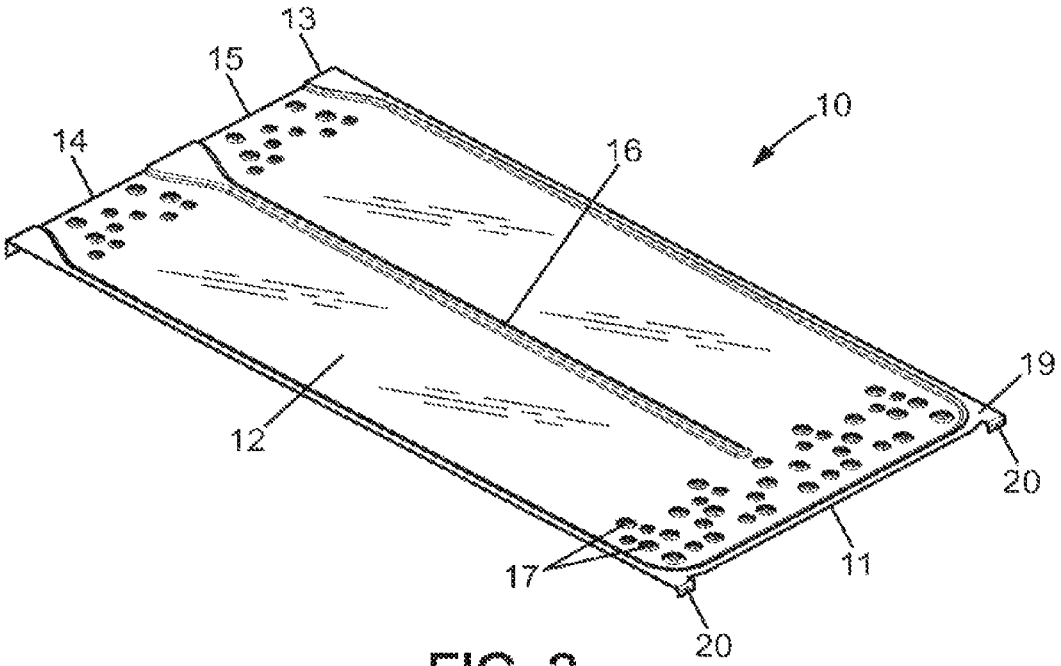
FIG. 2 is a perspective view of a plate for a heat exchanger, according to a first embodiment of the invention.
Figure 3:
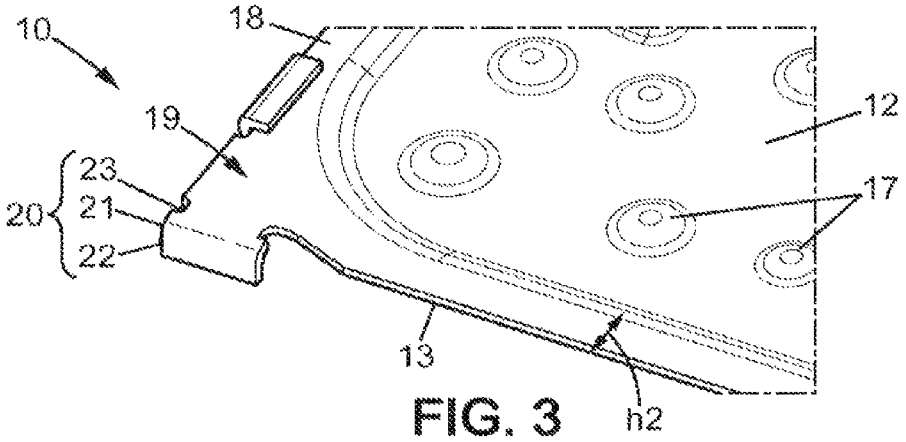
FIG. 3 is a partial and enlarged view of the plate in FIG. 2 showing a corner thereof, equipped with a fusible component.
Figure 4:
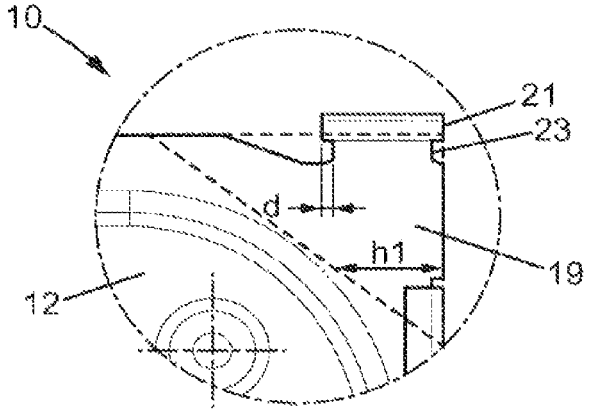
FIG. 4 is a schematic depiction viewed from above of the corner of the plate in FIG. 3; a region of the plate capable of carrying a fusible component, including a corner, is shown in dashed lines.
Figure 5:
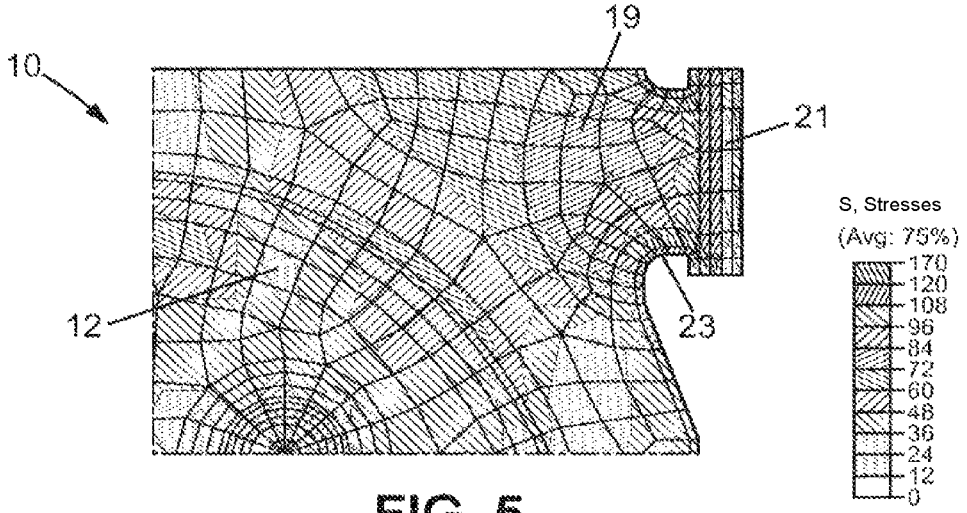
FIG. 5 shows the corner of the plate in FIG. 3 when it is subjected to thermal cycles.

This plate 10 also has four corners 19, only one being shown in FIGS. 3 to 5. Each corner 19 defines an edge surrounding a part of said ribs 14.

The first transverse edge 13 of the plate 10, receiving the fluid inlet and fluid outlet, has a continuous lip for joining it to a casing wall, while the two corners 19 of the opposite transverse edge from this first edge 13 each comprise a fusible component 20.

The first transverse edge 13 of the plate 10 makes it possible to ensure sealing at the fluid inlet and fluid outlet.

Each fusible component 20 in this case has a curved tab 21 having a joining surface 22, and a predetermined weakening region 23 connecting this curved tab 21 to the corresponding corner 19 of the plate 10 so as to allow the separation of this curved tab 21 from the corresponding corner 19.

Since the joining surfaces 22 of the fusible components 20 are flat, the opposite lateral walls of the casing are also flat in the regions for joining these joining surfaces 22 to the casing walls.

This predetermined weakening region 23 is in this case obtained by cutting a part of the lateral edges of the body of the fusible component 20, these notches making it possible to generate breaking initiation.

These notches are in this case rectangular or substantially rectangular.

The depth of the notches is determined such that the separation is realized after a few thermal cycles of expansion/contraction of this plate 10.

In the present case, and purely by way of illustration, the longest side of this notch has a dimension less than or equal to 1 mm and its short side has a dimension less than or equal to 0.5 mm.

FIG. 5 shows, by way of a digital simulation, the good results obtained with this plate 10 for a heat exchanger when it is subjected to thermal cycles.

As can be seen, the stresses are concentrated in the predetermined weakening region 23.

After breaking of the fusible components 20, the plate 10 for a heat exchanger is detached at its sides comprising fusible components.

Figure 6:
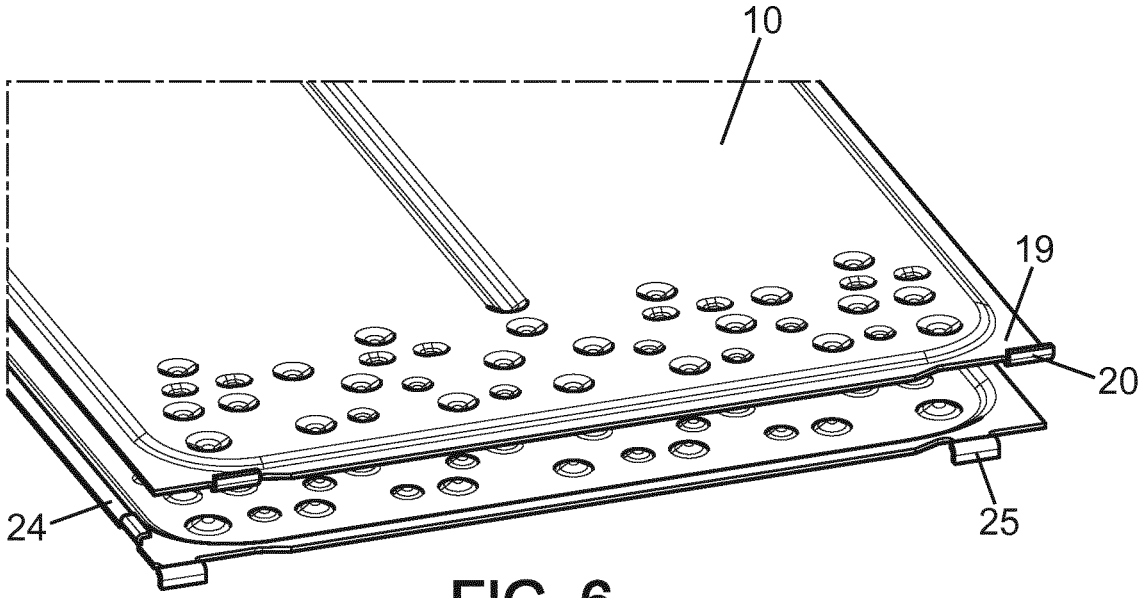
FIG. 6 shows a partial view of two plates for a heat exchanger that are superimposed with a view to being joined together so as to form a pair of plates.
Figure 7:
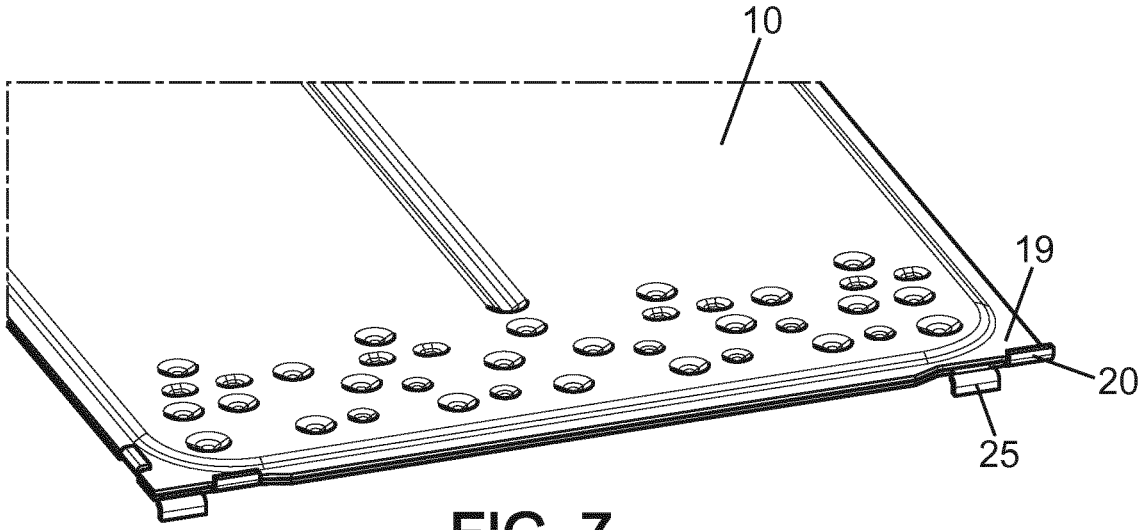
FIG. 7 is a partial view of a pair of plates, the corners of the lower transverse edges of these plates thus superimposed each having a fusible component; the fusible components on each corner being offset between the two plates by being placed in the continuation of one another.

FIGS. 6 and 7 illustrate the joining of a plate 10 as described above to another plate 24 so as to define a pair of plates that delimit between one another a passage for the flow of a fluid. The elements of FIGS. 6 and 7 that have the same references as those described in FIGS. 2 to 5 represent the same objects, and these will not be described again below.

The side of this pair of plates 10, 24 thus shown has, at each of its opposite corners 19, two fusible components 20, 25.

The two fusible components 20, 25 of each corner 19 of the pair each belong to a different plate 10, 24 and are offset relative to one another while being in the continuation of one another.

Figure 8:
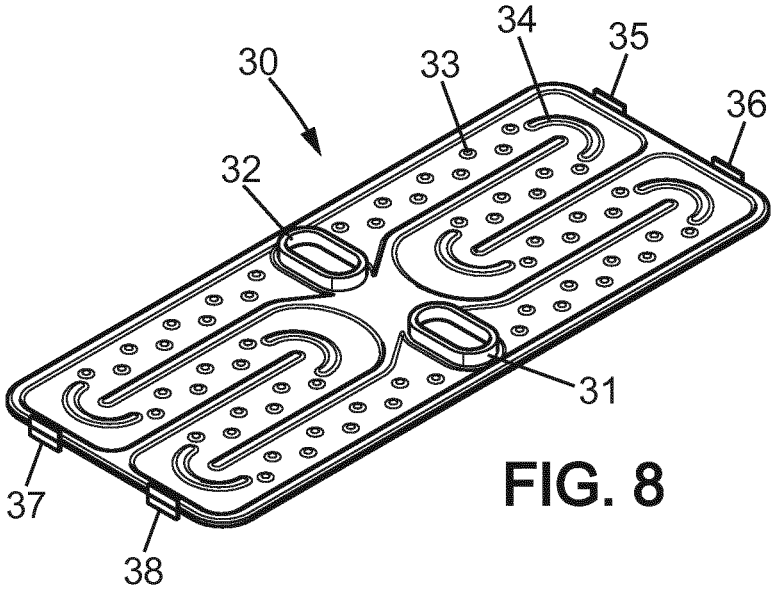
FIG. 8 is a perspective view of a plate for a heat exchanger, according to a second embodiment of the invention.

FIG. 8 is a perspective view of a plate 30 for a heat exchanger, according to a second embodiment of the invention.

This plate 30 comprises a fluid inlet 31 and a fluid outlet 32, each of the fluid inlet and fluid outlet having a collar and an elongate shape.

Since the plate 30 has a length (L) and a width (h), said fluid inlet and fluid outlet 31, 32 are placed along the length (L) at a distance from the lateral edges of the plate corresponding to L/2, or substantially L/2.

Protrusions 33 make it possible to disturb the circulation of the fluid while ribs 34 give fluid flow passages a meandering path having half-turns between the fluid inlet and fluid outlet 31, 32.

This plate 30 has fusible components 35-38 on both sides thereof extending in a transverse direction.

FIG. 9 schematically shows a plate for a heat exchanger, according to a third embodiment of the invention.

This plate 40 has a fluid inlet 41 and a fluid outlet 42 that are placed on the same side of the plate, this side 43 extending in a transverse direction. Each of said fluid inlet 41 and fluid outlet 42 have a collar and an elongate shape.

This plate 40 has a fusible component 44 in each corner 45 of its opposite side from the side 43 extending in a transverse direction on which the fluid inlet and outlet are situated.

This side 43 extending in a transverse direction has a continuous lip intended to be brazed to a casing wall.

Since the sealing of the fluid inlet and fluid outlet is ensured by a collar, the side 43 may alternatively receive fusible components 44.

The invention claimed is:

1. A plate for a heat exchanger, comprising:

a coupling edge coupling the plate to another plate, wherein the coupling edge has at least one fusible component forming at least one brazed joint between the coupling edge and the at least one casing wall, the at least one fusible component is configured to be separated from the coupling edge by differential expansion/contraction between the plate and the at least one casing wall to which the at least one fusible component forms the at least one brazed joint.

2. The plate as claimed in claim 1, wherein the at least one fusible component is at a corner of the plate or at a portion of the coupling edge that is close to the corner, the portion having a width greater than the width of the coupling edge in a median part of the plate.

3. The plate as claimed in claim 1, wherein two opposite corners of the plate each have a fusible component for joining the coupling edge to a single casing wall or opposite casing walls.

4. The plate as claimed in claim 1, wherein the coupling edge has a width in a median part of the plate that is greater than or equal to a predetermined safety width for which a break in the at least one fusible component does not propagate beyond the coupling edge, the coupling edge has a fusible component in the median part of the plate.

5. The plate as claimed in claim 1, wherein each fusible component has a predetermined weakening region so as to bring about separation thereof from the coupling edge.

6. The plate as claimed in claim 5, wherein the at least one fusible component has a line of lower mechanical strength.

7. The plate as claimed in claim 5, wherein the at least one fusible component has at least one notch.

8. The plate as claimed in claim 1, wherein the plate comprises a fluid inlet and a fluid outlet, each of the fluid inlet and fluid outlet having a collar.

9. The plate as claimed in claim 8, wherein fusible components are placed on two opposite sides of the plate.

10. The plate as claimed in claim 1, wherein a first side of the plate comprises a fluid inlet and a fluid outlet that are placed at a head of the plate.

11. The plate as claimed in claim 10, wherein the first side has a continuous lip and an opposite side of the plate from the first side has at least one fusible component.

12. The plate as claimed in claim 1, wherein each fusible component has a joining surface that is configured to be joined to the at least one casing wall, a longitudinal dimension of which is between 3 and 20 mm.

13. The plate as claimed in claim 1, wherein the plate is in one piece and is made from metallic material, as aluminium, or aluminium alloy.

14. A pair of plates for a heat exchanger as claimed in claim 1, the coupling edges of these plates being configured to be joined so as to delimit a duct for circulation of a heat transfer fluid between these plates, each coupling edge comprising at least one fusible component, the fusible components being arranged at the edges of the plates such that, after the plates have been joined, two fusible components belonging to separate plates are placed next to one another or are offset relative to one another.

15. A plate-type heat exchanger having at least two plates as claimed in claim 1, the two plates being joined together so as to delimit a duct for circulation of a heat transfer fluid between these plates, at least one edge of an assembly thus formed, which is connected to a casing wall, having, for each of these plates, at least one fusible component, the at least one fusible component that are placed at the at least one edge being positioned next to one another or being offset relative to one another.

16. The plate as claimed in claim 1, further comprising a concave area delimited by the coupling edge.

17. The plate as claimed in claim 1, further comprising a central rib with a projection separating a surface of an inner wall of the plate.

* * * * *